US011007804B2

(12) United States Patent
Umehara

(10) Patent No.: US 11,007,804 B2
(45) Date of Patent: May 18, 2021

(54) INKJET PRINTING APPARATUS WITH MEMBER FOR LATCHING CARRIAGE

(71) Applicant: CANON KABUSHIKI KAISHA, Tokyo (JP)

(72) Inventor: Kosuke Umehara, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/655,059

(22) Filed: Jul. 20, 2017

(65) Prior Publication Data

US 2018/0029397 A1 Feb. 1, 2018

(30) Foreign Application Priority Data

Aug. 1, 2016 (JP) ..... JP2016-151524

(51) Int. Cl.

| | |
|---|---|
| ***B41J 29/393*** | (2006.01) |
| ***B41J 2/165*** | (2006.01) |
| ***B41J 2/175*** | (2006.01) |
| ***B41J 29/02*** | (2006.01) |

(Continued)

(52) U.S. Cl.

CPC ..... *B41J 29/393* (2013.01); *B41J 2/16508* (2013.01); *B41J 2/16517* (2013.01); *B41J 2/16532* (2013.01); *B41J 2/175* (2013.01); *B41J 2/17509* (2013.01); *B41J 2/17566* (2013.01); *B41J 29/02* (2013.01); *B41J 2/00* (2013.01); *B41J 29/00* (2013.01); *B41J 2002/17579* (2013.01)

(58) Field of Classification Search

CPC ..... B41J 29/393; B41J 2/16532; B41J 2/175; B41J 2/17566; B41J 2/16585; B41J 2/16588; B41J 25/001; B41J 25/304; B41J 25/3082

See application file for complete search history.

(56) References Cited

U.S. PATENT DOCUMENTS 5,587,729 A 12/1996 Lee et al.
7,988,255 B2 * 8/2011 Balcan ..... B41J 23/025 347/32

(Continued)

FOREIGN PATENT DOCUMENTS

JP H06-001052 A 1/1994
JP H08-224881 A 9/1996

(Continued)

OTHER PUBLICATIONS

Office Action dated Jun. 5, 2020, in Japanese Patent Application No. 2016-151524.

*Primary Examiner* — Alejandro Valencia
(74) *Attorney, Agent, or Firm* — Venable LLP

(57) ABSTRACT

An inkjet printing apparatus comprises a carriage, on which a printhead is mounted, configured to move, a lever member configured to be rotatable about a rotating shaft and to be engageable with an engaging portion of the carriage, and a cam mechanism configured to have first and second locked states in which the lever member engages with the engaging portion of the carriage. The first locked state restricts a rotation of the lever member so as not to release an engagement with the engaging portion, and the second locked state allows the rotation of the lever member so as to release the engagement with the engaging portion.

7 Claims, 5 Drawing Sheets

(51) Int. Cl.
*B41J 2/00* (2006.01)
*B41J 29/00* (2006.01)

(56) References Cited

U.S. PATENT DOCUMENTS

| | | | | |
|---|---|---|---|---|
| 8,152,269 | B2 * | 4/2012 | Takeuchi | B41J 2/16532 347/32 |
| 8,162,442 | B2 * | 4/2012 | Kameyama | B41J 2/17526 347/49 |
| 2005/0052510 | A1 * | 3/2005 | Ju | B41J 2/1752 347/86 |
| 2010/0045715 | A1 * | 2/2010 | Takeuchi | B41J 2/16532 347/9 |

FOREIGN PATENT DOCUMENTS

| | | | |
|---|---|---|---|
| JP | 2005-125759 | A | 5/2005 |
| JP | 2006-264127 | A | 10/2006 |

* cited by examiner

INKJET PRINTING APPARATUS WITH MEMBER FOR LATCHING CARRIAGE

BACKGROUND OF THE INVENTION

Field of the Invention

The present invention relates to an inkjet printing apparatus and, more particularly, to a mechanism of locking a carriage so the carriage will not move from a predetermined position.

Description of the Related Art

A conventional inkjet printing apparatus performs, other than a printing operation, a maintenance operation of a printhead to prevent the attachment of a foreign particle such as dust to a nozzle surface of a printhead and prevent clogging due to drying of ink in a nozzle. In the maintenance operation, good ink-discharge capability of the printhead is maintained by moving the printhead to a capping position and sucking the ink by a pump or the like in a state in which the nozzle surface of the printhead is tightly sealed by a cap member. In addition, the inkjet printing apparatus needs to be locked so the carriage holding the printhead will not move from the capping position due to vibration or shock at a time of transport. Japanese Patent Laid-Open No. 6-1052 discloses an arrangement in which a shaft projecting from a carriage is locked by engaging the shaft to an elastically-deforming engaging portion of a fixed member which is rotatably supported by a frame. Japanese Patent Laid-Open No. 8-224881 discloses an arrangement in which a carriage is locked by using a rotating cam mechanism which is used for the maintenance operation of a printhead.

However, the arrangements disclosed in the aforementioned Japanese Patent Laid-Open Nos. 6-1052 and 8-224881, respectively, cannot reliably fix the carriage and require the use of a dedicated fixing member, a tape, or a packaging material to lock the carriage to prevent its movement.

SUMMARY OF THE INVENTION

The present invention has been made in consideration of the aforementioned problems, and provides a lock mechanism that can reliably lock a carriage.

In order to solve the aforementioned problems, the present invention provides an inkjet printing apparatus comprising a carriage, on which a printhead is mounted, configured to move; a lever member configured to be rotatable about a rotating shaft and be engageable with an engaging portion of the carriage; and a cam mechanism configured to have first and second locked states in which the lever member engages with the engaging portion of the carriage, wherein the first locked state restricts a rotation of the lever member so as not to release an engagement with the engaging portion, and the second locked state allows the rotation of the lever member so as to release the engagement with the engaging portion.

According to the present invention, a lock mechanism that can reliably lock a carriage can be implemented.

Further features of the present invention will become apparent from the following description of exemplary embodiments (with reference to the attached drawings).

DESCRIPTION OF THE EMBODIMENTS

Embodiments of the present invention will now be described in detail with reference to the accompanying drawings.

In this specification, the term "printing" (to be also referred to as "print") not only includes the formation of significant information such as characters and graphics, but also broadly includes the formation of images, figures, patterns, and the like on a printing medium, or the processing of the medium, regardless of whether they are significant or insignificant and whether they are so visualized as to be visually perceivable by humans.

Also, the term "printing medium" not only includes paper used in common printing apparatuses, but also broadly includes materials, such as cloth, a plastic film, a metal plate, glass, ceramics, wood, and leather, capable of accepting ink.

Furthermore, the term "ink" should be extensively interpreted similarly to the definition of "printing (print)" described above. That is, "ink" includes a liquid which, when applied onto a printing medium, can form images, figures, patterns, and the like, can process the printing medium, or can process ink (for example, solidify or insolubilize a coloring agent contained in ink applied to the printing medium).

Further, the term "printing element" (to be also referred to as a "nozzle") generically means an ink orifice or a fluid channel communicating with it, and an element which generates energy used to discharge ink, unless otherwise specified.

<Apparatus Arrangement>

An inkjet printing apparatus according to an embodiment of the present invention will be explained with reference to FIGS. 2A and 2B.

Figure 1:
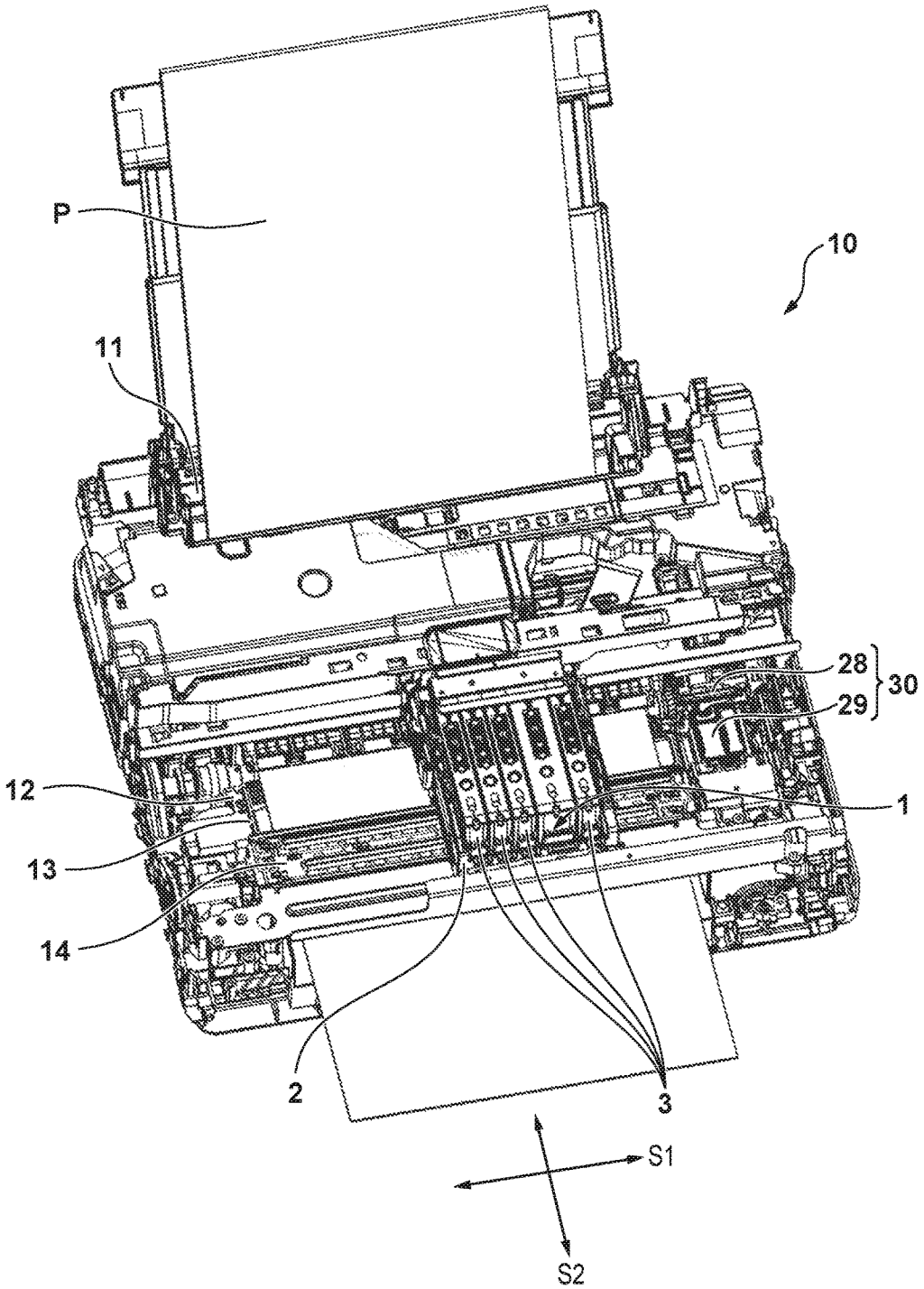
FIG. 1 is a perspective view showing an inkjet printing apparatus according to an embodiment.

In the inkjet printing apparatus 10, as shown in FIG. 1, an inkjet printhead (to be referred to as a printhead hereinafter) 1 which prints by discharging ink according to an inkjet method is mounted on a carriage 2. The carriage 2 reciprocates in directions S1 (scanning directions) to print. A printing medium P such as printing paper is fed via a paper feed mechanism 11, and conveyed to a printing position. At the printing position, the printhead 1 discharges ink to the printing medium P to print.

On the carriage 2 of an inkjet printing apparatus 10, an ink cartridge 3 which stores ink to be supplied to the printhead 1 is also mounted in addition to the printhead 1. The ink cartridge 3 is detachable from the carriage 2.

The inkjet printing apparatus 10 shown in FIG. 1 is capable of color printing. For this purpose, four ink cartridges which store magenta (M), cyan (C), yellow (Y), and black (K) inks, respectively, are mounted on the carriage 2. These four ink cartridges 3 are independently detachable.

The printhead 1 according to the embodiment employs an inkjet method of discharging ink by using thermal energy. The printhead 1 therefore includes electrothermal transducers. The electrothermal transducers are arranged in correspondence with respective orifices. A pulse voltage is applied to a corresponding electrothermal transducer in accordance with a printing signal, discharging ink from a corresponding orifice.

The inkjet printing apparatus 10 also includes the sheet supply mechanism 11, a conveyance roller 12, a platen 13, a sheet discharge roller 14, and a maintenance device 30 (to be described later). The plurality of printing media P stacked in the sheet supply mechanism 11 are separated one by one by the sheet supply mechanism 11 and the conveyance roller 12 and are conveyed onto the platen 13. The printing medium P is sent to the platen 13 at a predetermined pitch (for example, one row) in a direction S2 (medium conveyance direction), and the printhead 1 discharges ink while moving, with respect to the printing medium P on the platen 13, in the directions S1 perpendicular to the direction S2. The printing medium P is printed by repeating this operation. When the printing of the printing medium P ends, the printing medium P is pinched by the conveyance roller 12 and the sheet discharge roller 14, conveyed in the direction S2, and discharged outside the apparatus. Near the starting end (home position) of the movement of the printhead 1 and the carriage 2, the maintenance device 30 is arranged to maintain a good ink-discharge state of the printhead 1.

The carriage 2 is slidably held on a first rail 15 and a second rail 16 which are arranged in parallel to each other in a front-and-rear direction and is capable of reciprocally moving in the directions S1. A driving pulley 22 is provided on the output shaft of a carriage motor 21, and a driven pulley 23 is rotatably supported by a shaft in a structure in the apparatus. A belt 24 looped between the driving pulley 22 and the driven pulley 23 is connected to the carriage 2. The belt 24 is rotated by driving the carriage motor 21, and the printhead 1 discharges ink on the printing medium to print while the carriage 2 reciprocally moves in the directions S1.

The maintenance device 30 includes maintenance members such as blade members 28 and a cap member 29 that perform maintenance to maintain good ink-discharging capability of the printhead 1. The cap member 29 can come into contact with and retract from the nozzle surface of the printhead 1. In a contact state, the cap member can prevent drying of the nozzle surface, and also suck and discharge, from each nozzle, ink including bubbles accumulated in each nozzle of the printhead 1. The blade members 28 are constituted by a pair of thin plates made of an elastic material such as rubber. The blade members sequentially contact and wipe the nozzle surface, removing an unwanted adherent matter such as dust or ink adhered to the nozzle surface.

<Driving Mechanism of Maintenance Device>

Figure 3:
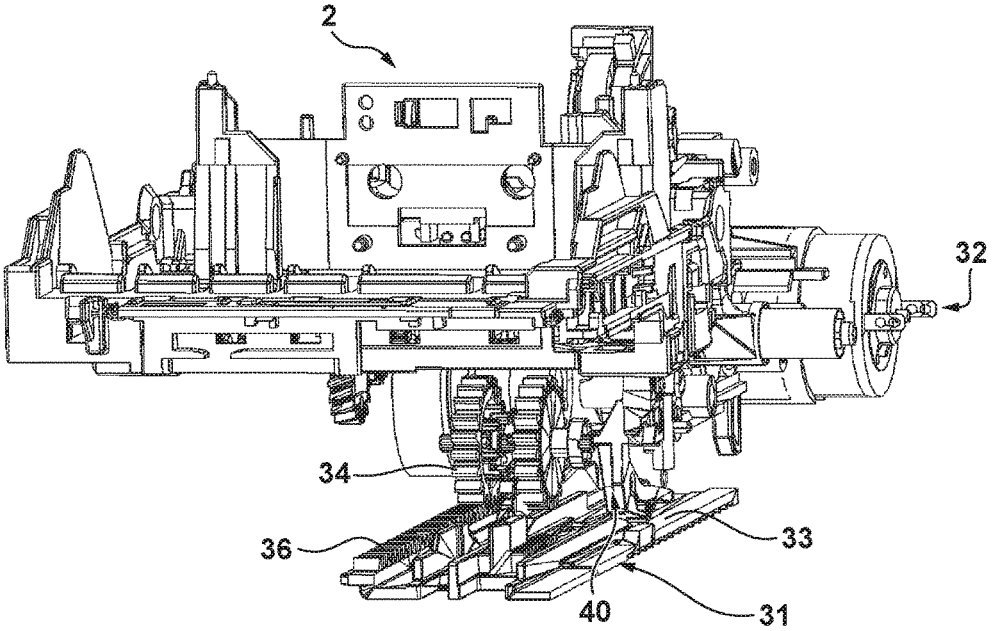
FIG. 3 is a perspective view showing a mechanism portion of a lock mechanism according to the embodiment.

FIG. 3 is a perspective view of a mechanism portion of the maintenance device 30 according to the embodiment.

The maintenance device 30 according to the embodiment includes a lock mechanism 40 for fixing the printhead 1 in a predetermined position and the aforementioned maintenance members such as the blade members 28 and the cap member 29. The maintenance device 30 according to the embodiment also includes a slider (to be referred to a cam slider hereinafter) 31 having a cam mechanism and a driving source 32 of the cam slider 31. In FIG. 3, the carriage 2 is in the position shown in FIG. 2B and is stopped in a predetermined position (maintenance position) set outside a printing area which is the scanning range at the time of printing. The maintenance members of the printhead 1 are arranged in this maintenance position, and the cam slider 31 is arranged below them. The cam slider 31 is a long plate member having, on its upper surface portion, a cam profile 33 for driving the maintenance members of the printhead 1, and a driving force output from a motor serving as the driving source 32 is transmitted to a cam driving gear 34. The cam driving gear 34 meshes with a rack gear 36 provided on the cam slider 31 and causes the cam slider 31 to linearly reciprocate (slide) along directions parallel to the directions S2. The maintenance members and the lock mechanism 40, which are follower members of the cam slider 31, are driven as the cam slider 31 slides.

The lock mechanism 40 is a lever member to fix the carriage 2 in a predetermined position (maintenance position). The lock mechanism 40 locks the printhead 1 in the predetermined position so the printhead will not move in the directions S1 during maintenance, thereby preventing ink droplets from splattering. The lock mechanism 40 is also provided to prevent the carriage 2 from inadvertently moving and breaking or falling at the time of transport.

The arrangement and the function of the lock mechanism 40 will be described next with reference to FIGS. 4 to 7.

Figure 2A:
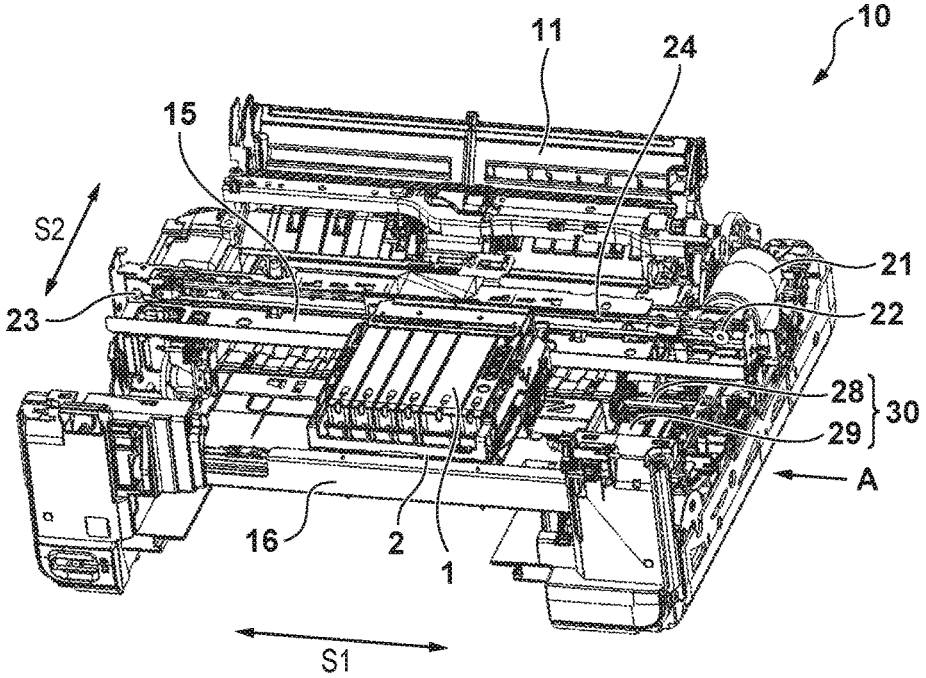
FIG. 2A is a perspective view showing a state in which a carriage is in a printing position in the inkjet printing apparatus according to the embodiment.
Figure 2B:
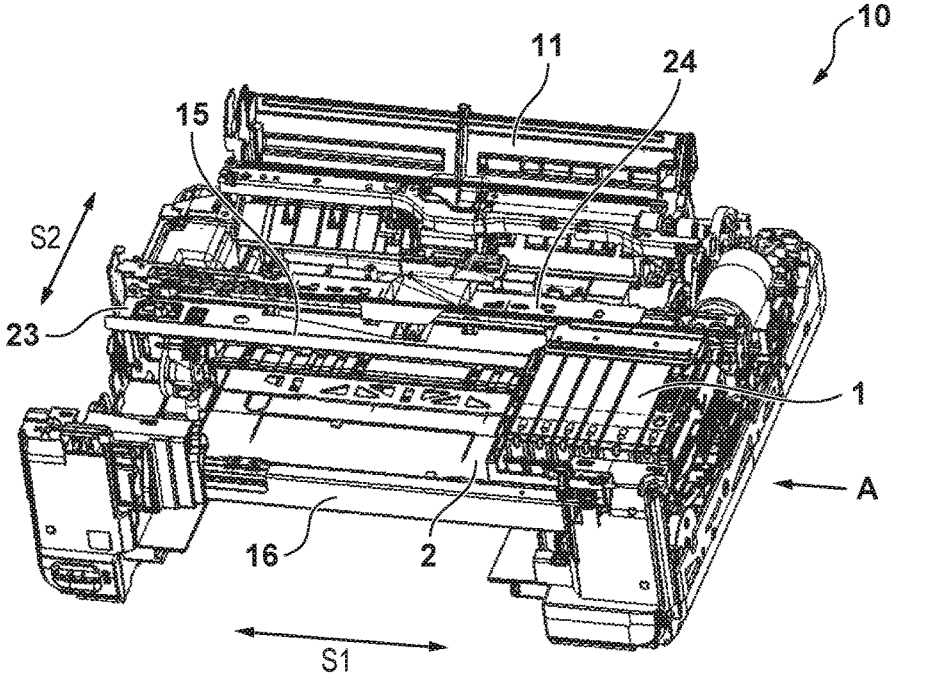
FIG. 2B is a perspective view showing a state in which the carriage is in a maintenance position in the inkjet printing apparatus according to the embodiment.
Figure 4:
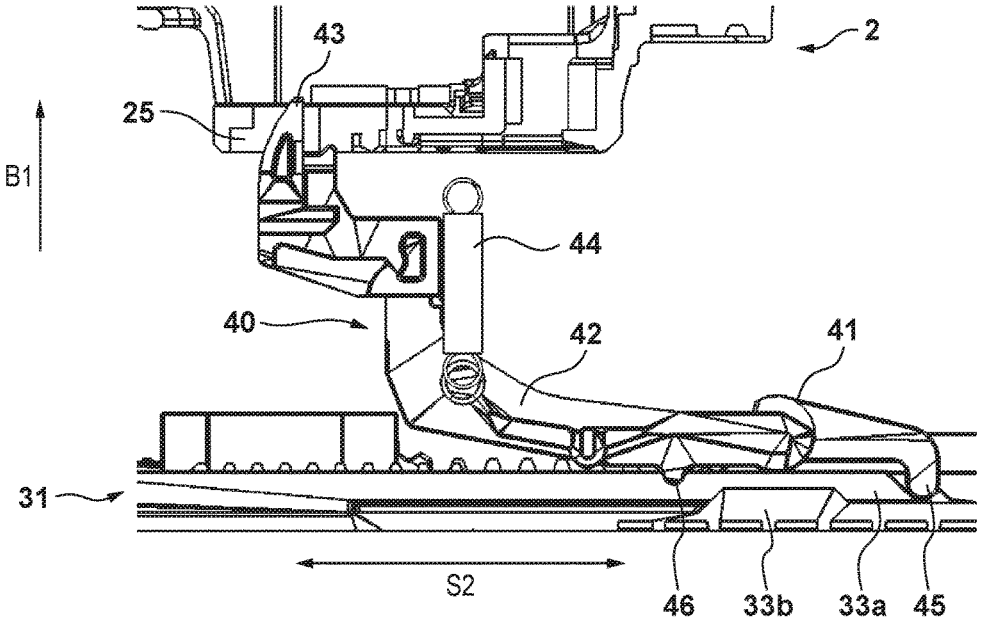
FIG. 4 is a view showing a first locked state by the lock mechanism according to the embodiment when viewed from a direction A in FIG. 2A.

FIG. 4 is a view showing a state in which the carriage 2 is locked by the lock mechanism 40 according to the embodiment when viewed from the direction A shown in FIG. 2A. In FIG. 4, the carriage 2 is in a predetermined position (maintenance position), and the lock mechanism 40 is in a first locked state. The lock mechanism 40 includes a lever member 42 that rotates about a predetermined rotating shaft 41 and a latch portion 43 connected to one end of the lever member 42. The one-end side of the lever member 42 is constantly biased toward a direction B1 (upward direction) by a latch spring 44 with respect to the rotating shaft 41. The latch portion 43 can hold an engaged state with an engaging portion 25 of the carriage 2 by the biasing force of the latch spring 44. One end of the latch spring 44 is attached to a fixed portion of the lock mechanism 40, and the other end is attached to a mold (not shown). Also, a first cam follower 45 in contact with a first cam profile 33*a* of the cam slider 31 (to be described later) is formed on the other end of the lever member 42. In addition, a second cam follower 46 in contact with a second cam profile 33*b* of the cam slider 31 is formed, on the lever member 42, on a side opposite to the first cam follower 45 with respect to the rotating shaft 41 of the lever member 42.

The engaging portion 25 of the carriage 2 is an engaging hole formed in the lower portion of the carriage 2 so as to be in a positional relationship that allows engagement with the latch portion 43 of the lock mechanism 40 when the carriage 2 has moved to the predetermined position (maintenance position). When the latch portion 43 is in an engaged state with the engaging portion 25, the carriage 2 is fixed either to a state (first locked state) in which the lever member 42 is biased in the direction B1 by the latch spring 44 or to a state (second locked state) in which the lever member 42 is not rotatable. The size of the opening of the engaging portion 25 is formed to be larger than the external dimensions (sectional shape) of the latch portion 43 of the lock mechanism 40 so that the latch portion 43 can easily enter the engaging portion 25. When the engaging portion 25 and the latch portion 43 are in the engaged state, only predetermined gaps are formed in the directions S1. As a result, the carriage 2 is restricted from moving a predetermined amount or more in the directions S1.

An operation to lock the carriage 2 and an operation to release the lock that are performed by the lock mechanism 40 by using the biasing force of the latch spring 44 and the reciprocal operation of the cam slider 31 will be described below.

Figure 5:
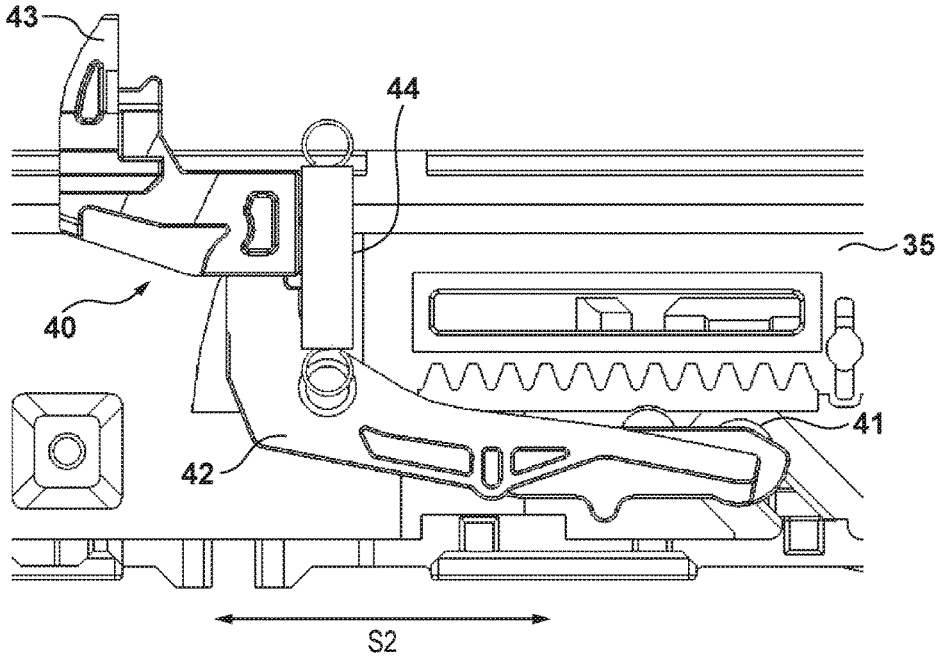
FIG. 5 is a view showing a connected state between a cam slider and the lock mechanism according to the embodiment when viewed from the direction A in FIG. 2A.

FIG. 4 is a view showing the first locked state in which the lock mechanism 40 locks the carriage 2 when viewed from the direction A shown in FIG. 2A. FIG. 5 is a view showing a connected state of the lock mechanism 40 and the cam slider 31 when viewed from the direction A shown in FIG. 2A. The cam slider 31 is provided with a follower connecting portion 35 to which the follower members are movably connected. The lever member 42 of the lock mechanism 40 is rotatably supported by this follower connecting portion 35.

In the states shown in FIGS. 4 and 5, the first cam follower 45 of the lock mechanism 40 is not in contact with the first cam profile 33*a* of the cam slider 31, and the second cam follower 46 is also not in contact with the second cam profile 33*b*. Hence, the lever member 42 of the lock mechanism 40 is allowed to rotate about the rotating shaft 41. In this state, the latch portion 43 of the lever member 42 is displaceable in a vertical direction (in the direction B1 and in the direction B2 opposite to the direction B1) when it is biased in the direction B1 by the latch spring 44. Accordingly, the engagement of the latch portion with the engaging portion 25 of the carriage 2 can be released when the lever member 42 rotates against the biasing force of the latch spring 44 and the latch portion 43 is lowered.

When the carriage 2 is moved to the predetermined position (maintenance position), the latch portion 43 of the lock mechanism 40 comes into contact with the lower portion of the carriage 2, and the lever member 42 is rotated in a counter clockwise direction against the biasing force of the latch spring 44. Subsequently, when the engaging portion 25 of the carriage 2 is moved to the position of the latch portion 43 of the lock mechanism 40, the lever member 42 is rotated in a clockwise direction by the biasing force of the latch spring 44, and the latch portion 43 is pushed up to its original state and is engaged with the engaging portion 25 of the carriage 2. In this first locked state, the latch portion 43 of the lock mechanism 40 holds an engaged state with the engaging portion 25 by receiving the biasing force of the latch spring 44, thereby restricting the carriage 2 from moving in the directions S1. In this manner, the lock mechanism 40 can restrict the carriage 2 from moving in the directions S1 so that maintenance can be performed by setting the nozzle surface of the printhead 1 mounted in the carriage 2 to be in a stable state.

Figure 6:
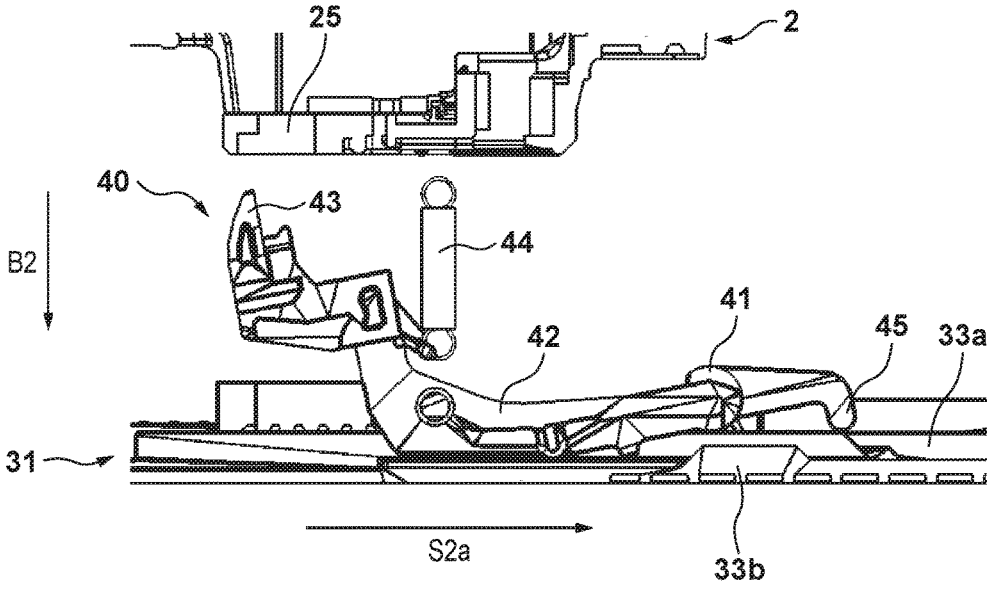
FIG. 6 is a view showing a lock release state by the lock mechanism according to the embodiment when viewed from the direction A in FIG. 2A.

FIG. 6 is a view showing a state in which the locked state of the carriage 2 by the lock mechanism 40 has been released when viewed from the direction A shown in FIG. 2A. In FIG. 6, the cam slider 31 moves in a direction S2*a* parallel to the direction S2 when the driving force is transmitted from the driving source 32 via the cam driving gear 34. When the cam slider 31 moves in the direction S2*a* from the state shown in FIG. 4, the first cam follower 45 of the lever member 42 of the lock mechanism 40 comes into contact with the first cam profile 33*a* of the cam slider 31. Since the first cam profile 33*a* has a predetermined height with respect to a reference surface, the first cam follower 45 of the lever member 42 of the lock mechanism 40 is lifted and rotated in the counter clockwise direction about the rotating shaft 41. As a result, the latch portion 43 of the lock mechanism 40 is lowered in the direction B2 and separated from the engaging portion 25 of the carriage 2, and the carriage 2 is released from the locked state and is set in a lock released state in which the carriage 2 is movable in the directions S1.

Figure 7:
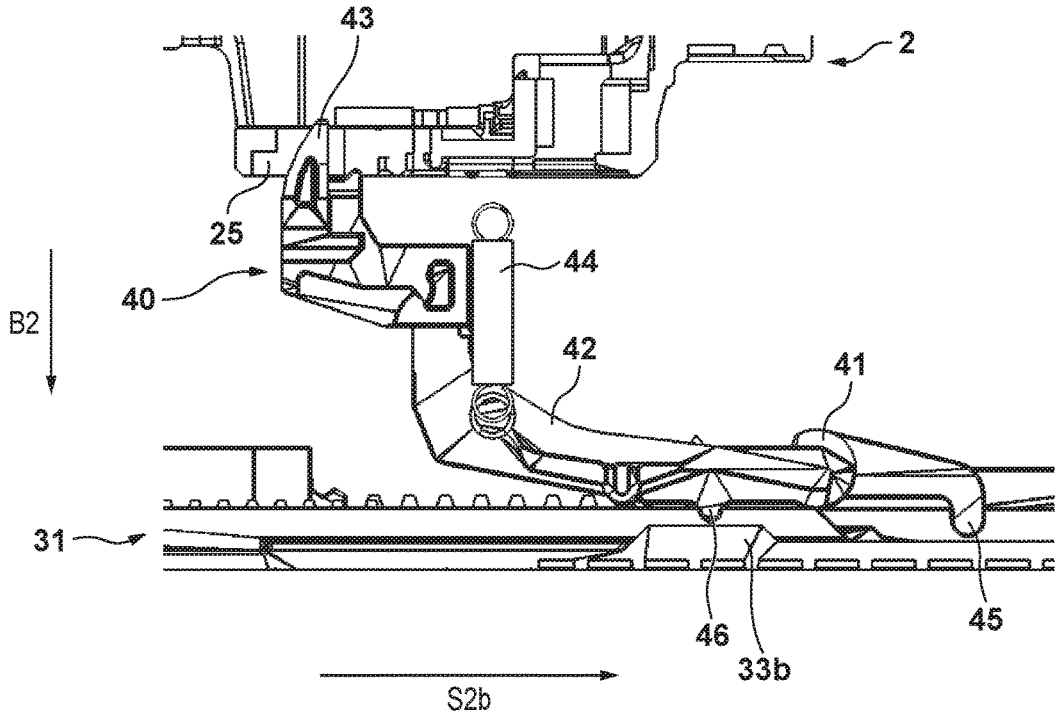
FIG. 7 is a view showing a second locked state by the lock mechanism according to the embodiment when viewed from the direction A in FIG. 2A.

FIG. 7 is a view showing the second locked state in which the carriage 2 is locked by the lock mechanism 40 and the lever member 42 of the lock mechanism 40 is not rotatable when viewed from the direction A shown in FIG. 2A. In FIG. 7, the cam slider 31 moves in a direction S2*b* parallel to the direction S2 when the driving force is transmitted from the driving source 32 via the cam driving gear 34. When the cam slider 31 moves in the direction S2*b* from the state shown in FIG. 4, the second cam follower 46 of the lever member 42 of the lock mechanism 40 comes into contact with the second cam profile 33*b* of the cam slider 31. Since the second cam profile 33*b* has a predetermined height with respect to the reference surface, the rotation of the lever member 42 of the lock mechanism 40 about the rotating shaft 41 in the counter clockwise direction is restricted. As a result, the latch portion 43 of the lock mechanism 40 cannot be lowered in the direction B2 and remains latched to the engaging portion 25 of the carriage 2, and the carriage 2 is held in a locked state and set in a locked state in which the carriage 2 is not movable in the directions S1. In this second locked state, even if the apparatus receives a shock or if the carriage 2 is forcefully moved, the lock mechanism 40 can reliably continue to lock the carriage 2. Hence, it is effective as a locking unit of the carriage 2 during transport of the apparatus.

According to this embodiment, a simple arrangement can be used to reliably fix the carriage. In addition, the cost can be decreased by eliminating a fixing member or a packaging member for locking the carriage which was necessary at the time of transport. Furthermore, a user operation to release the lock can be reduced.

Note that, in this embodiment, an example of the arrangement of the cam slider 31 that performs a translation movement has been described. However, the present invention is also applicable to an arrangement in which the cam rotates.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-151524, filed Aug. 1, 2016, which is hereby incorporated by reference herein in its entirety.

What is claimed is:

1. An inkjet printing apparatus comprising:

a carriage, on which a printhead is mounted, and which is configured to move;

a latch member arranged in the apparatus, and configured to be engageable with an engaging portion of the carriage; and a cam mechanism including a first cam profile and a second cam profile, and configured to switch between i) a first locked state, in which the latch member engages the engaging portion, the first cam profile is not in contact with a first cam follower of the latch member, and the second cam profile is not in contact with a second cam follower of the latch member, and ii) a second locked state, in which the latch member engages the engaging portion, the first cam profile is not in contact with the first cam follower, and the second cam profile is in contact with the second cam follower.

2. The apparatus according to claim 1, wherein the cam mechanism includes a slider configured to perform a translation movement in a direction intersecting with a direction in which the carriage moves.

3. The apparatus according to claim 1, wherein the first cam profile allows the latch member to rotate by the first cam profile being in contact with the first cam follower, and the second cam profile restricts the rotation of the latch member by the second cam profile being in contact with the second cam follower.

4. The apparatus according to claim 1, wherein, in a case in which the cam mechanism is in a lock release state in which the latch member does not engage the engaging portion, the first cam profile is in contact with the first cam follower and the second cam profile is not in contact with the second cam follower.

5. The apparatus according to claim 1, wherein the cam mechanism is positioned in the first locked state in a case in which maintenance of a nozzle surface of the printhead is to be performed, and the cam mechanism is positioned in the second locked state in a case in which transport of the inkjet printing apparatus is to be performed.

6. The apparatus according to claim 1, wherein the latch member has a latch portion that is provided on one end of the latch member, and the engaging portion of the carriage is an engaging hole that is engageable with the latch portion of the latch member.

7. The apparatus according to claim 1, further comprising a biasing unit configured to bias the latch member toward the engaging portion.

* * * * *